US007351934B2

(12) United States Patent
Devroy

(10) Patent No.: US 7,351,934 B2
(45) Date of Patent: Apr. 1, 2008

(54) LOW VOLTAGE WARMING BLANKET

(76) Inventor: Gary Devroy, 214 Pondridge Rd., Libertyville, IL (US) 60048

( * ) Notice: Subject to any disclaimer, the term of this patent is extended or adjusted under 35 U.S.C. 154(b) by 0 days.

(21) Appl. No.: 11/181,466

(22) Filed: Jul. 14, 2005

(65) Prior Publication Data

US 2007/0012675 A1 Jan. 18, 2007

(51) Int. Cl.
*H05B 1/00* (2006.01)
*H05B 3/00* (2006.01)

(52) U.S. Cl. ..... 219/212; 219/202; 219/529; 219/492

(58) Field of Classification Search ..... 219/212, 219/211, 217, 527–529, 543, 548, 549, 202, 219/492
See application file for complete search history.

(56) References Cited

U.S. PATENT DOCUMENTS 4,277,670 A * 7/1981 Mori et al. ..... 219/492
4,633,062 A * 12/1986 Nishida et al. ..... 219/212
5,148,002 A * 9/1992 Kuo et al. ..... 219/211
5,861,610 A * 1/1999 Weiss ..... 219/497
5,994,669 A * 11/1999 McCall ..... 219/209
6,329,635 B1 * 12/2001 Leong et al. ..... 219/121.83
6,331,695 B1 * 12/2001 West ..... 219/212
6,452,138 B1 * 9/2002 Kochman et al. ..... 219/549
6,649,873 B1 * 11/2003 Cintron et al. ..... 219/211
6,770,848 B2 * 8/2004 Haas et al. ..... 219/212
2002/0153367 A1 * 10/2002 Haas et al. ..... 219/543
2003/0052120 A1 * 3/2003 Zabrowsky et al. ..... 219/501
2005/0242770 A1 * 11/2005 Britto ..... 320/110

* cited by examiner

*Primary Examiner*—Tu Ba Hoang
*Assistant Examiner*—Vinod Patel

(57) ABSTRACT

A low voltage warming blanket adapted for use in vehicles powered by the vehicles DC power source is provided with a control selectively actuatable to activate the blanket for one of a plurality of preset time periods at at least one pre-set temperature, the control having a reset button to reinitiate activation upon expiration of the time period, the blanket being provided with thermal sensors preventing overheating.

6 Claims, 2 Drawing Sheets

LOW VOLTAGE WARMING BLANKET

FIELD OF THE INVENTION

This invention relates to electric blanket devices and more particularly to a low voltage electric blanket for automotive use incorporating preset timing periods.

BACKGROUND OF THE INVENTION

Electric heating pads, electric blankets, electric throws, and other localized fabric material heating devices are well known. Such devices commonly employ a heating area, generally in the form of a fabric member which is associated with one or more heating elements generally positioned interior of a multi-layer fabric member and safety and control circuitry which may include temperature setting selectively actuatable controls coupled to temperature sensors in the area of the elements. Such devices may be provided for different voltages. It has also been known to provide heated seats in automobiles and other vehicles where the heating coils are positioned under the seat surface and where the actuating controls include both on/off switches, temperature sensors preventing overheating and, in some instances, circuitry which deactivates either upon the attaining of a predetermined temperature or upon the expiration of a set time period. It has also been known to interface such seats with the vehicles ignition system so that the seat heating is disabled when the ignition is turned off. While such heated seats in vehicles have proven utility in cold weather regions, they are generally expensive, not retrofittable into existing vehicles, and limited in that they provide heat only to the surface area of the seat itself and therefore generally do not provide heat to occupant's legs or frontal regions.

It has long been common to provide blankets, throws and other passive warming devices for use in vehicles, however the adoption and use of electric heating for such is limited for considerations of safety, versatility and battery overuse.

Generally, electric outlets provided for use in vehicles, including more recently in aircraft, consist of low voltage sockets, generally of the type previously known as cigar lighter sockets, which often are independent of the ignition switch and continue to provide a power source, even when the engine is not running. Electric utilizing devices plugged into such sockets, if left on after the engine and its associated generator or alternator have been turned off, can rapidly drain the vehicle's battery.

In those instances where the power socket, however, has been integrated into association with the ignition, power is not available when the ignition is off, although during such periods there may be a desire to power various electronic devices. A normal expedient is to provide for an accessories position of the ignition system that does continue to provide power to the sockets as well as other areas of the vehicle. However, in the event of a relatively high drain power use device, such as would be provided by an electric warmer, long term use of such devices with the ignition in the accessory position can lead to excessive battery drain.

SUMMARY OF THE INVENTION

This invention provides a heated blanket or throw preferably comprising a fabric, woven or non-woven, body having heating elements or coils associated therewith, preferably interior, adapted to be powered by a low voltage source of the type typically found in vehicles. The invention includes a control which includes temperature sensors associated with the heated area, an actuating switch, a timing system provided with a plurality of pre-determined time periods effective to terminate heating upon the expiration of a selected one of the periods, and in an embodiment, a temperature selector.

By use of a timing circuit, the device of this invention can be operated in a vehicle without fear of excessive battery discharge, irrespective of whether or not the power source socket is or is not associated with the ignition system or whether the ignition system is left in the accessories position. The use of the timing circuit also provides for use in a more convenient fashion in that a user, for example a driver anticipating having a passenger having the need for additional warmth, can activate the heating prior to the passenger's entry into the vehicle, irrespective of whether or not the engine is running, without fear that a delay in the arrival of the passenger will cause undue battery drain.

By use of a plurality of preset time periods, the invention can be operated for both short and longer trips. In an embodiment the actuating switch functions as a reset switch to allow immediate or selected reactivation of the blanket structure upon expiration of the time period. In an embodiment activation of the reset button prior to the expiration of the time period will reset the running of the time period.

It is therefore an object of this invention to provide an improved heating throw or blanket for vehicle use.

It is another and more specific object of this invention to provide a low voltage heated blanket or throw for vehicle use having a plurality of preset operating time periods selectively actuatable by a user.

It is a further object of this invention to provide a vehicle usable low voltage heated blanket or throw having overheat safety features incorporated therein.

It is a further object of this invention an embodiment to provide a low voltage heated blanket or throw adapted for use in vehicles having a control system providing for selected time periods of activation, selected degrees of heating, overheating protection and a reset mechanism.

Other objects and features of the invention will be apparent from the description of the preferred embodiment.

DESCRIPTION OF THE PREFERRED EMBODIMENTS

Figure 1:
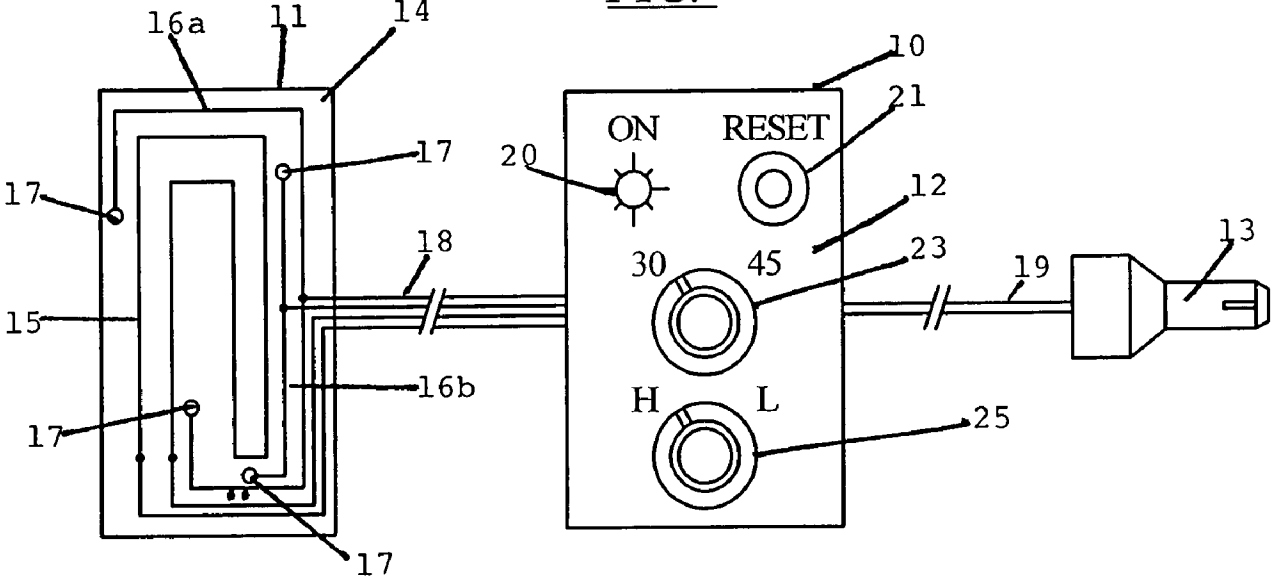
FIG. 1 is a diagrammatic view of a heated throw and control according to this invention utilizing heat sensors separate from the heating element.

As shown in FIG. 1 the low voltage electric blanket device 10 of this invention is provided with a heated section 11, a control 12 and a plug 13. The plug 13 is preferably the type used with power sockets in vehicles which are connected to the vehicle DC low voltage system. As used herein, low voltage will be understood to mean that type of low voltage system generally used in vehicles, most commonly 12 or 24 volt, although in some systems higher voltages are known. Electric cords 18 and 19 connecting respectively the heated blanket area 11 to the control 12 and the control 12 to the plug are of a length to allow the blanket area to be positioned remote from the plug such as when the power socket is dash located and the user is in a rear seat while positioning the control near the user.

The heated area 11 consists of a blanket or throw 14 which is preferably formed of a fabric, either woven or non-woven and which may be bordered in any desired fashion or unboarded. Preferably the blanket or throw 14 is dimensioned for convenient use in a vehicle and may preferably be of the type known as a laptop throw. A preferred size would be approximately 3.5-4 feet by 4-5 feet. Embedded within the material of the blanket is a standard heating element or coil 15 of the type generally used for such devices. In the illustrated embodiment a single circuit heating element is illustrated, however it would be understood that the invention could encompass multiple, independent heating circuits.

In the embodiment of FIG. 1, separate temperature circuits 16 are provided having temperature sensors 17 positioned separately of the heating coil. As illustrated, two such circuits can be provided, 16*a* and 16*b*, each designed to provide separate heat sensing input to the master control. The control 12 preferably includes of an "on" indicator which is an LED 20 signaling that the system is activated. An initial activation and reset switch 21 is also provided at the control which both initiates operation and which can be reactivated to reinitiate operation or to reset operation as more fully explained below. The control also includes a selective timer, control or switch 23 which in this instance, as illustrated, may set the on cycle for 30 minutes or for 45 minutes. Other time periods can be provided or, if desired, more than two timer periods provided.

Further, in an embodiment, the control includes a temperature selection control 25. This may be a two position control as illustrated, high and low, a multi-position selector or a continuously re-positioning selector allowing an infinite range between high and low settings. Where a two position selector is utilized and separate heating circuits 16*a* or *b* are utilized, one circuit may be actuated at one position of the selector 25 with the other circuits activated at the other position. This allows for the use of preset sensors 17.

Figure 2:
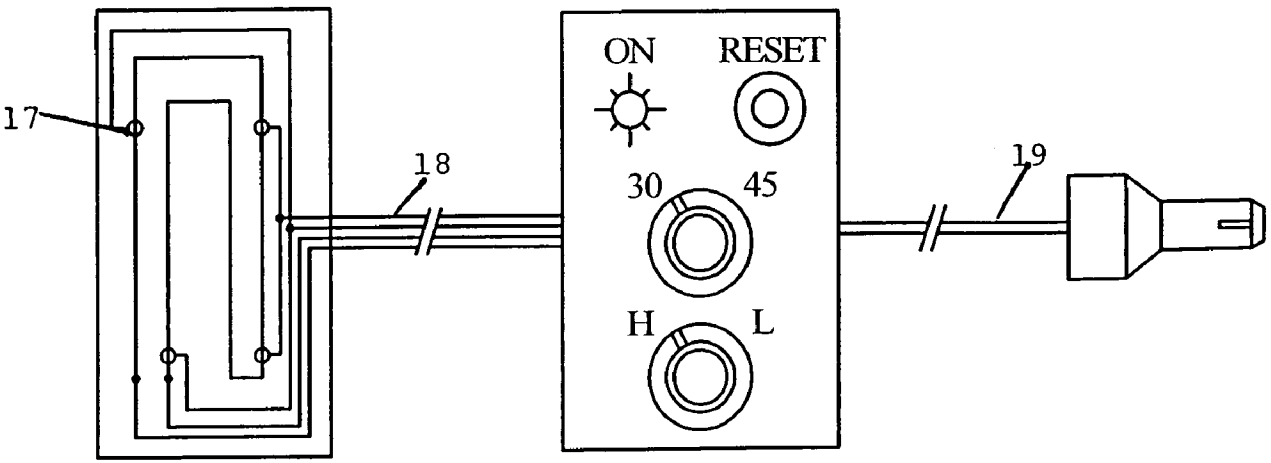
FIG. 2 is a view similar to FIG. 1 utilizing heat sensors integrated into the heating element.

In a modification of the embodiment of FIGS. 1 and 2, the "on" indicator 20 may comprise an indicator light and a switch, in which case the reset switch 21 will act solely to reset the timer to a baseline or zero position. Preferably the reset is recessed into the housing of the control or is a soft switch flush with the housing surface or otherwise protected against inadvertent operation. It will be understood by persons skilled in the art that there are many ways that this can be accomplished to meet an objective of preventing accidental actuation of the reset such as might occur when the control is set aside and pressed upon by some other weight such as a parcel being placed on top of it.

FIG. 2 differs from FIG. 1 substantially only in that the sensors 17 are positioned immediately adjacent to or incorporated directly into the heating coil. In such an instance the sensors may be an automatic resetting break/unbreak switch of the type that opens in the presence of excessive heat thus breaking the circuit through the heating coil and automatically closes upon cooling. Such sensors can best be utilized with a single heating circuit, simple temperature embodiment not having a dual temperature setting indicated at 25. Otherwise, the sensors as shown are of the type to provide a temperature sensing feedback to the control where the sensors' signal output is proportional to the sensed temperature, the control having a threshold signal receiving circuitry which terminates activation of the heating coil upon receipt of a signal in excess of the desired temperature.

In a further embodiment the sensors can be a continuous feed sensor to a control which adjusts voltage through the coil. In such an embodiment the heated area 11 will maintain a substantially constant temperature once that temperature is reached in accordance with the temperature setting, either by way of the control 25 or by a predetermined setting. All such variations of utilizing sensors are known from the heating pad and electric blanket art.

The circuitry of the control 12 can be relatively simple and many variations thereof will be apparent to those of skill in the art. In essence there is provided an actuator switch coupling the current flow from the plug to the heating coil, a timer set at the time of activation which breaks the connection between plug and heating coil upon expiration of the chosen time, and a reset that resets the timer to a base or zero position reestablishing the connection as long as the actuator or "on" switch is in the actuated position. A further make/break circuit interposed between the plug and the coil and preferably in the control is controlled by the sensors 17.

Figure 3:
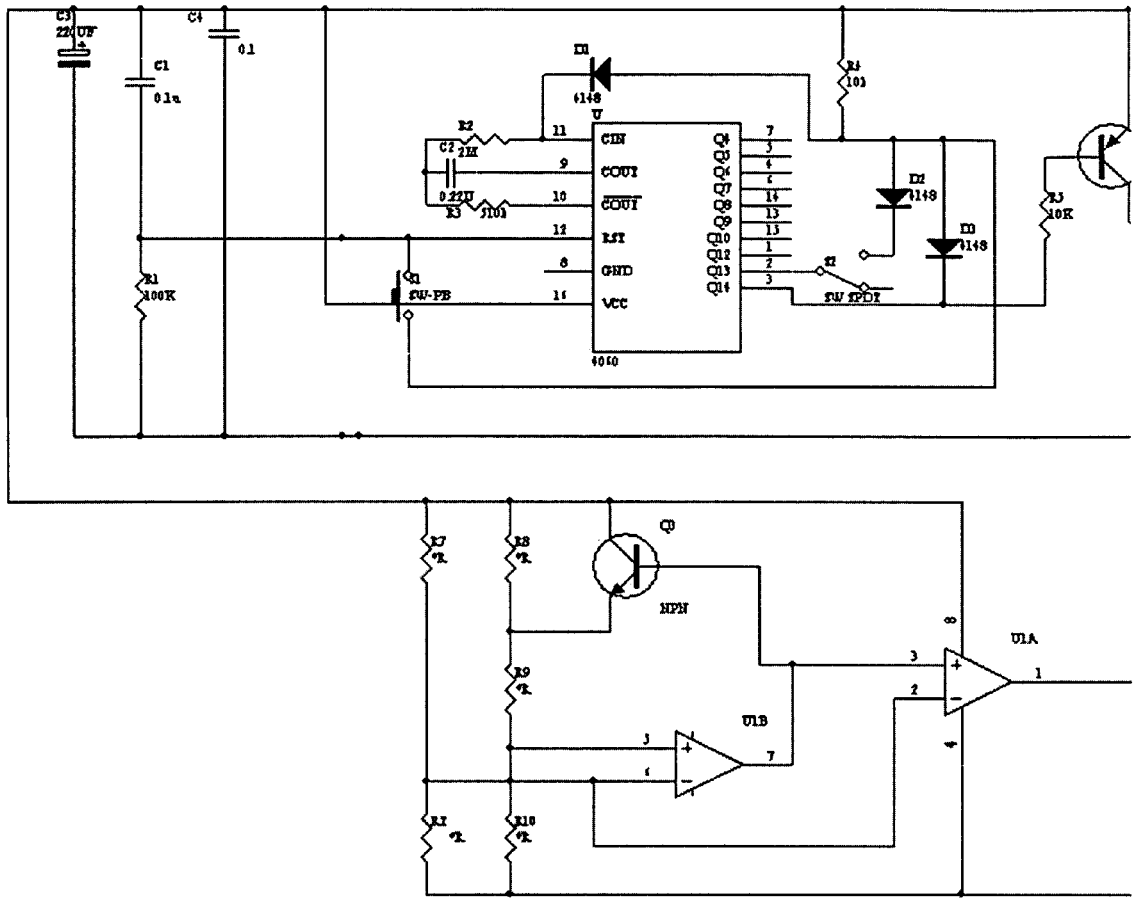
FIG. 3 is an exemplary circuit diagram illustrating a circuit utilizable with this invention.

FIG. 3 illustrates one preferred circuit with each of the component specifications identified. The operation of this circuit will be apparent to those skilled in the art.

It will therefore be recognized that my invention provides an improved heated blanket or throw for use in vehicles which, in a preferred embodiment is provided with an at least a two position timer controlling duration of heating to prevent excess battery drain and which incorporates heating sensors preventing overheating and where a reset button will reinstitute heating at the expiration of the timing device, or if desired, earlier.

I claim as my invention:

1. A low voltage heated electric blanket for automotive use comprising a heated blanket area comprising a fabric member having heating coils associated therewith and temperature sensors, the heating coils and temperature sensors positioned within the fabric member, and electronically connected to a controller, the controller having a reset switch and automatic timer such that upon activation of said reset switch, the blanket is switched into heating mode and the timer is initiated, said timer deactivating activation of the heating coils upon passage of a predetermined period of time from activation, and the heating coils remaining deactivated until intentionally reactivated by manually reactivating the reset switch, an indicator for indicating activation, a plug adapted to be received in an automotive power socket connected to an automotive battery, the plug electronically connected to the controller, the blanket being separate from seats in the vehicle and being positionable on the body of an occupant of the vehicle wherein, the heating coils are not automatically reactivated once said predetermined period of time has passed to reduce battery drain and are manually reactivated in order to turn the blanket on.

2. The low voltage heated blanket of claim 1 wherein the control has a plurality of preset time positions, each of which can be selected independent of the other.

3. The low voltage heated blanket of claim 2 wherein the sensors are independent of the coil.

4. The low voltage heated blanket of claim 2 wherein the sensors provide at least one make/break connection within a length of the coil.

5. The low voltage heated blanket of claim 2 wherein the control includes a temperature selector effective to select one of a plurality of different preset operating temperatures for the blanket.

6. The low voltage heated blanket of claim 2 wherein the controller is positioned remote from the fabric member intermediate the plug and the fabric member.

* * * * *